United States Patent [19]

Duke

[11] Patent Number: 4,741,282

[45] Date of Patent: May 3, 1988

[54] SAIL

[76] Inventor: Terrence R. Duke, 9 Lucknow Place, Blockhouse Bay, Auckland 4, New Zealand

[21] Appl. No.: 927,123

[22] Filed: Nov. 5, 1986

[30] Foreign Application Priority Data

Nov. 5, 1985 [NZ] New Zealand ..... 214082

[51] Int. Cl.[4] ..... B63H 9/04

[52] U.S. Cl. ..... 114/103

[58] Field of Search ..... 114/39, 102, 103; 244/219

[56] References Cited

U.S. PATENT DOCUMENTS 3,391,668 7/1968 Birchill ..... 114/103

4,116,406 9/1978 Hamilton ..... 244/219

*Primary Examiner*—Joseph F. Peters, Jr.

*Assistant Examiner*—Jesùs D. Sotelo

*Attorney, Agent, or Firm*—Young & Thompson

[57] ABSTRACT

An aerofoil sail, with two sailcloth sides of substantially equal area and shape, and an airspace between them, and includes vents by which the airspace may be inflated by the wind, and structure by which either side of the sail may be made shorter from tack to clew than the other.

7 Claims, 3 Drawing Sheets

SAIL

Figure 1:
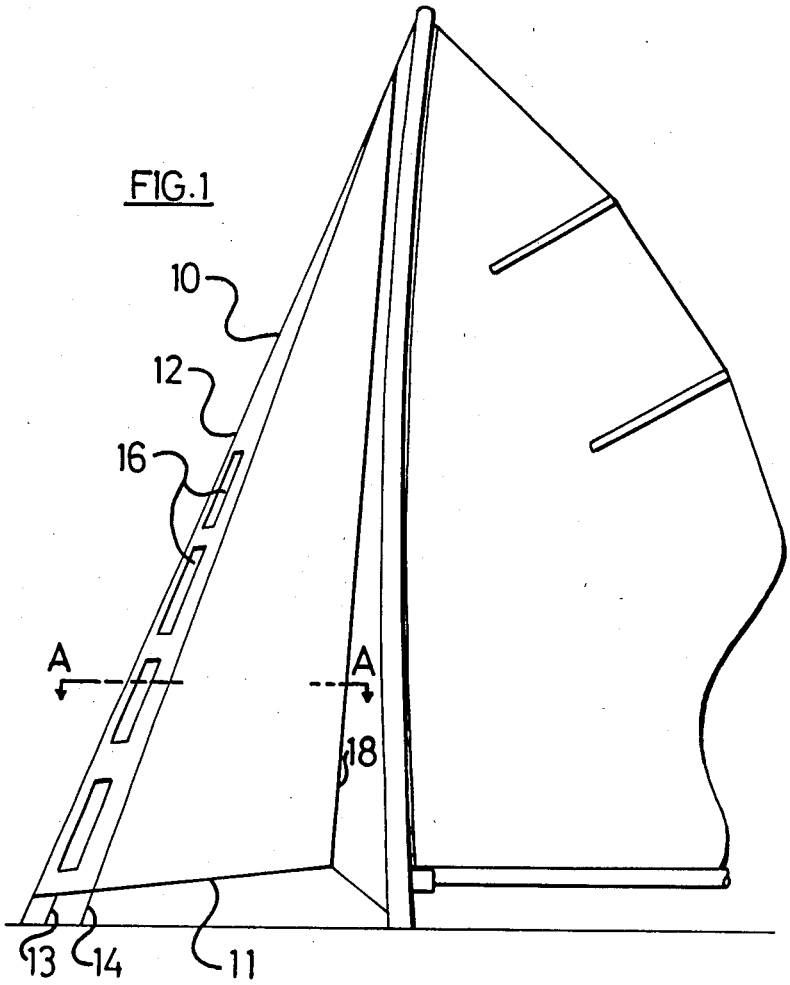

This invention relates to improvements in the design of sails, particularly main and fore sails for use on fore-and-aft rigged boats and ships.

Hitherto many efforts have been made to improve the shape of a sail when in use, so as to make it more aerodynamically efficient, and more similar to the shape of an aircraft wing. In the same way as the wing of an aircraft generates lift, a sail of this shape is intended to generate forward movement by altering the air pressure in front of and behind the sail. However, the solid and rigid struts used to create this shape for the sail, while effective in their role, have problems associated with them. They are hard to stow when not in use, difficult to step up and take down, heavy in comparison to an ordinary sail, and relatively expensive in many cases. The most important problem, however, is that these sails are in many cases difficult or impossible to alter from a shape suited to wind from one quarter to a shape suited to wind from another quarter. It is often necessary to compromise the efficiency of the sail when taking measures in the design to make this possible.

U.S. Pat. No. 3,391,688—J. Birchill—discloses a double-sided sail which does not rely on rigid struts to create an aerodynamically efficient shape, but which instead is inflated by wind. This apparatus is however not able to be changed from one configuration to another in response to winds from different directions, and is instead given a generalised form which is to some degree suitable for use with wind from any quarter.

U.S. Pat. No. 2,569,318—H.H. Kersten—shows a double sided sail having long battens extending horizontally across each surface at intervals up the sail in pairs. The mast is of a special shape, and forms part of the 'wing'. Means is disclosed by which the battens can be used to warp the sail to either of two configurations. The mechanism is however necessarily considerably heavier than a conventional sail, as well as being bulky and more difficult to store. The requirement for a specialised mast also makes the sail unsuitable for use with many existing boats, wherein provision of a new mast is impractical.

It is an object of this invention to go at least partway towards overcoming some of the problems associated with shaped sails of this type.

In one aspect the invention provides an aerofoil sail.

Preferably the sail is formed principally from fabric and cord or wire.

Preferably the sail may be used as a foresail.

In another aspect the invention provides an aerofoil sail with a pair of spaced apart sides.

Preferably the spaced apart sides are held apart by air.

Preferably vents are provided by which the said air may enter and leave, along the front and rear of the sail.

In another aspect the invention provides a means of shortening or lengthening either side of the sail, such that either side may form either the bowed or the flat surface of the aerofoil shape.

These, and other aspects of this invention, which should be considered in all its novel aspects, will become apparent in the following description given by way of example only, with reference to the accompanying drawings, in which:

FIG. 1: shows a preferred foresail embodiment of the invention in side elevation.

Figure 2:
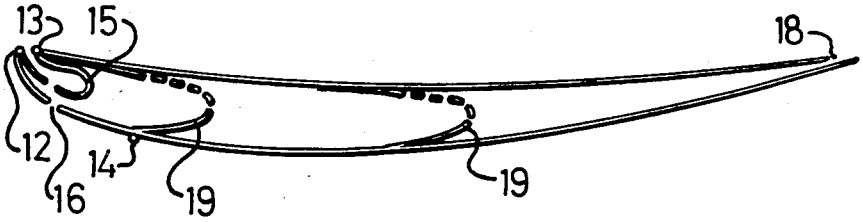

FIG. 2: shows the same embodiment in plan elevation, sectioned along line A—A.

Figure 3:
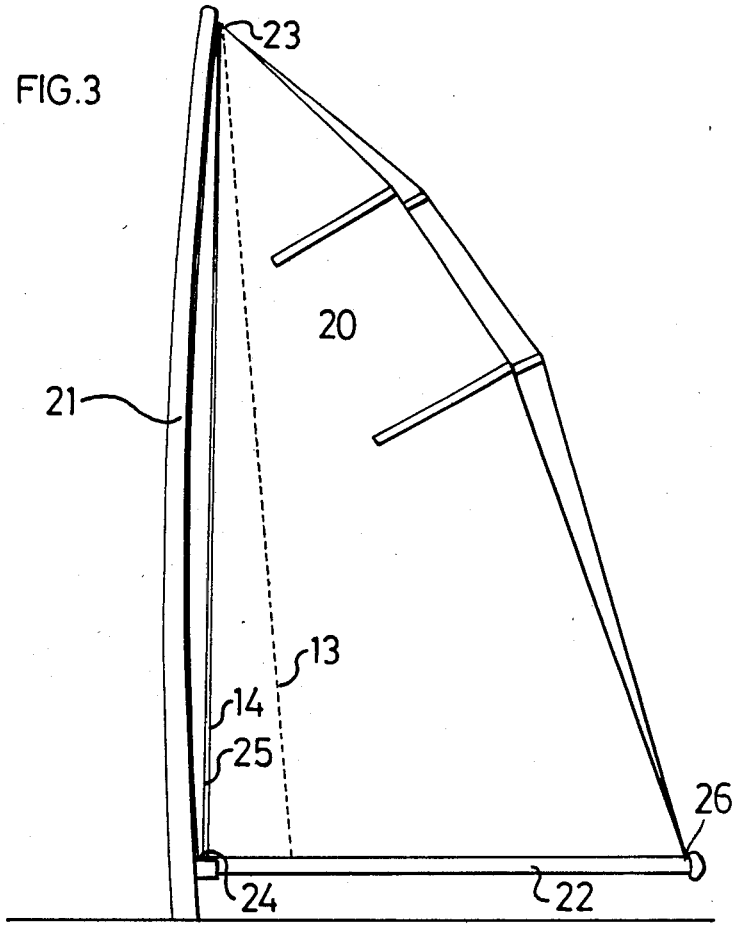

FIG. 3: shows a preferred mainsail embodiment of the invention in side elevation.

Figure 4:
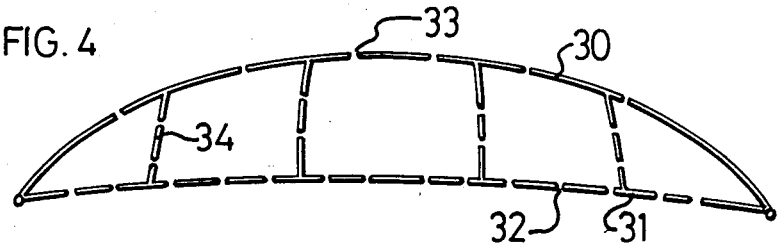

FIG. 4: shows a preferred spinnaker embodiment of the invention, sectioned and in plan elevation.

Figure 5:
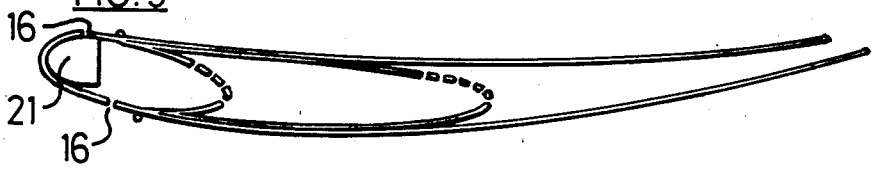

FIG. 5: shows a second mainsail embodiment of the invention sectioned and in plan elevation.

Figure 6:
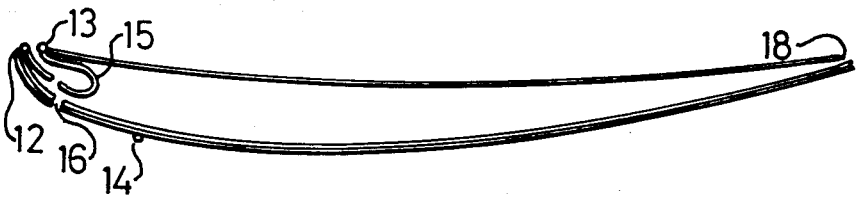

FIG. 6: shows a second foresail embodiment of the invention sectioned and in plan elevation.

In its preferred embodiment the invention is a sail formed from two flexible sheets, joined along at least the leading 10 and the lower 11 edges. Flexible sheets may be defined for the purposes of this specification as being sheets of fabric or other material which are able to bow and fold in substantially any direction, but preferably not stretch to any substantial degree. The term is intended to include conventional sailcloths or sheet materials, and also includes sheets of such material having 'floating' battens associated with parts thereof as are commonly associated with the leech of a sail, said battens not traversing the draft of the aerofoil shape. The draft may be defined as the area of maximum camber in the aerofoil shape of a sail in use. The sail of the present invention might be used in a mainsail design or, as shown in FIG. 1 in a foresail design, and could easily be used, possibly with modifications, for other sails. FIG. 1 shows the sail with the near side bowed outwards, and the far side drawn flat. The leading edge of the sail is held and controlled by the operation of three cords or wires—the forestay 12 and another line 13, 14 on each of the sides. These lines act to alternately tighten and slacken the sides, to either draw them flatter or allow them to bow out. In use, the line 13 on one side is hauled forward to lie substantially adjacent the forestay 12 while the other 14 is loosened.

Because the lines are fixed to the sail at some distance back from the leading edge, the act of bringing a wire forward creates a pocket 15, which is pushed and sucked by the prevailing air currents into the internal cavity of the sail as shown, thereby shortening the effective length of one side of the sail and flattening it. By hauling the other line 14 in and slackening the first line 13, the aerofoil shape of the sail automatically switches over to its mirror image, so as to be useful when sailing on the opposite tack.

Vents 16 in the sail between the forestay 12 and the line 14 are exposed on the slackened side of the sail, whereas on the tightened side they are covered in the pocket 15. Air may enter through these vents to expand the inner cavity 17 such that the sail naturally takes on its proper shape.

Further vents may be provided along the rear edge 18 of the sail, so as to prevent the sail "ballooning" out into a rounder shape which is more wind resistant, or instead the two sides of the sail may be unconnected along this edge as shown.

Many variations may be made to this basic design, with varying results.

One or more baffles 19 of sealed or perforated fabric may be provided in the inner cavity 17 to vary the air pressure in the sail at different points, thereby "fine-tuning" the shape of the sail when air inflates it. The vents in the baffles may be bigger or more frequent in some than in others to accentuate this. Possibly the vents in the baffles or in the front and rear of the sail may have controlled shutters such that the shape of the sail can be altered to suit different wind and sailing conditions. The shutters could be opened and shut with zippers, or with a louvre system. To further accentuate the difference in the internal pressure of different parts of the sail, the sailcloth of the baffles and/or the sail sheets themselves can be coloured differently in different parts—if coloured black or a dark colour, the enclosed air will become warmer than if coloured white or a light colour, and will consequently expand, increasing the internal pressure in that part. By selectively colouring different parts of the sail, the internal pressures can be altered to provide a better sail shape.

Similarly, additional vents may be provided at selected points across the sail surfaces to further modify the internal pressure in differnet parts of the sail.

The foremost baffle, and possibly also subsequent baffles, will preferably be attached to the said sheets along or adjacent the lines 13 and 14 so as to prevent or reduce the tendency of the sail to bulge out only in the spaces between baffles, producing a series of 'billows' in the outer surface. By attaching the baffles along these fixed lines, constriction of the sail at these points is avoided. Similarly, by attaching a number of baffles of increasing sizes at the same points, a series of chambers can be created in the sail without the sail surface being indented at intervals.

The shape of the sail will differ in accordance with its type and useage. As well as the usual variations in sail shape and form necessary with different applications, some further modifications may be desirable.

A jib or foresail will preferably be substantially as described above, and as shown in FIG. 1, with differences to suit different vessels, sailing conditions and uses, as in prior art sails.

A mainsail will preferably have an additional line adjacent the leading edge. As shown in FIG. 3, a mainsail 20 is traditionally supported along the leading edge or luff by the mast 21, with a line sewn into the sail edge held in a track along the length of the mast. The foot of the mainsail is similarly fixed to the boom 22.

In use a mast tends to bow outwards in the middle with the various strains it is under, such that the line of the leading edge of the sail between head 23 and tack 24 is not a straight one. If the wire 13 or 14 is brought forward to the tack so as to shorten one side of the sail, as described above, a gap will occur where the mast curves away from the wire, and an air inlet may occur on the short side of the sail where preferably there is none.

This does not generally occur with a foresail, wherein the leading edge is held by the forestay 12, because the forestay tends to bow inwards rather than outwards, with the result that when a line 13 or 14 is brought forward to lie adjacent the forestay, no gap will normally occur at any point between the two, even if only held together at top and bottom.

A mainsail will therefore preferably differ from a foresail in that a line 25 is provided, fixed to the sail in such a way that if forms a straight line between the head and the tack of the mainsail, rather than following the curve of the mast. The line 13 or 14 can be brought forward to abut against this line and form a substantially unbroken surface along one side of the sail.

A spinnaker or a sail for square-rigged vessels of the present invention will differ from a fore or mainsail as described above, in a number of aspects, because of the different manner in which they function.

A sail of this type is always faced to the wind in the same direction, and consequently does not need to be reversed. No wires 13 or 14 are required, and the forward sheet 30 is bigger than the back sheet 31. Inlet holes 32 are provided at intervals along the rear of the sail, and outlet holes 33 along the front.

Baffles 34 occur at points inside the sail to facilitate a correct distribution of pressures for an efficient sail shape.

The inlets and outlets, and vents in the baffles may have controlled shutters to alter the distribution of pressure in the sail, and thereby to 'fine tune' the shape of the sail to suit sailing with the wind from either behind and to the left or behind and to the right.

Although the system of wires described above for shortening one or other sides of the sail appears preferable at present, a number of other systems are possible. Zippers might be used to create the pockets 15, with one half of each running alongside the forestay 12 or line 25 in the case of mainsails, and the other halves alongside lines 13 and 14.

This would possibly be less easy and fast to operate than the line system, but could have the advantage of more securely closing off the pocket 15, and is within the scope of this invention.

Another system which might be used either separately or in addition to the wire or the zipper systems described above to lengthen one side relative to the other, is a system for pulling the clew 26 of one side back or the other forward.

In this way the distance between tack 24 and clew 26 is less on one side, while the amount of sailcloth remains the same and the sail may bow out deeper on the side as a consequence. Such a system might be put into practice in a number of ways—on a mainsail the clew of each side might be attached to a separate runner, each able to move back and forth on a rail or track on the boom. On a foresail each clew may be attached to the mast with an elongable connector, or the two clews might be connected by a cord passing around a pulley on the mast, such that as one clew is pulled back towards the mast, the other is let out. A piece of light sailcloth connecting the trailing edges of the sides may be desirable to help maintain the aerofoil shape along the whole length of the sail.

A further system is illustrated in FIG. 5, wherein the sail sides are joined along the leading edge, around the mast or forestay. Preferably using a wire system similar to that described above, the sail is pulled around the mast 21 or forestay to increase the area of one side and decrease the area of the other, with the forward vents 16 on the reduced side being closed off by abutment with the mast or forestay surface, as shown, and those on the increased side being open.

A sail using one or more of the above operating systems could be made having three sheets rather than two, the central sheet possibly being of a standard weight sailcloth, and the outer two being lighter weight. In practice one other of the outer sheets would be reduced in area to form the flatter side, while the central sheet and the outer sheet on the other side bow outwards.

Finally it will be appreciated that a wide variety of other changes and alterations might be made to the above example, within the spirit and scope of this invention, as exemplified by the following claims:

I claim:

1. A sail including:

at least two opposed flexible sheets, at least one vent by which air may in normal use flow into a space between said flexible sheets, and, at least one outlet vent by which air may in normal use flow out of said space between said flexible sheets, said sail taking in normal use an aerofoil shape having two outer faces comprised of said at least two opposed flexible sheets with a first said face having a greater useful surface area than the second said face, wherein said opposed flexible sheets are connected by at least one flexible element joined to both, forming at least one baffle, said at least one baffle extending substantially vertically between said opposed flexible sheets, and having at least one vent therein through which air may flow in normal use.

2. A sail as claimed in claim 1, including means by which said useful surface are of at least one said face of the sail can be adjusted such that said useful surface area of said at least one face of the sail can be made greater than that of the other.

3. A sail as claimed in claim 2, wherein said means includes apparatus by which non-adjacent parts of at least one said flexible sheet can be brought together, such that intervening parts of said at least one flexible sheet form a pocket which does not in normal use comprise apart of said useful surface area of either said face of the sail, and by which non-adjacent parts of said at least one flexible sheet can be disassociated, such that a pocket of intervening parts of said at least one flexible sheet is unformed.

4. A sail as claimed in claim 3, wherein said apparatus by which non-adjacent parts of said at least one flexible sheet or sheets can be brought together and disassociated includes lines integral with said non-adjacent parts.

5. A sail as claimed in claim 3, wherein said apparatus by which non-adjacent parts of said at least one flexible sheet can be brought together and disassociated includes at least one zip fastener having two engageable tracks, each of said engageable tracks being associated with a different one of said non-adjacent parts.

6. A sail as claimed in claim 3, wherein said at least one inlet vent is formed in said intevening parts of said at least one flexible sheet.

7. A sail as claimed in claim 1, wherein said at least two flexible sheets include central flexible sheet and two outer flexible sheets, wherein said central flexible sheet and a first said outer flexible sheet act in combination to provide a second side of said sail, said first said outer flexible sheet having a greater useful surface area than the other said outer flexible sheet.

* * * * *